US005193237A

United States Patent [19]

Holdredge

[11] Patent Number: 5,193,237

[45] Date of Patent: Mar. 16, 1993

[54] PNEUMATIC WHEEL CHAIR CUSHION FOR REDUCING ISCHEMIC INJURY

[76] Inventor: Terry K. Holdredge, 346 Town Creek Dr., Anderson, S.C. 29621

[21] Appl. No.: 647,031

[22] Filed: Jan. 28, 1991

[51] Int. Cl.[5] ..... A47C 27/08

[52] U.S. Cl. ..... 5/654; 5/453; 5/455; 5/914; 297/DIG. 8; 137/625.11; 137/625.12; 137/625.13; 91/39; 91/279

[58] Field of Search ..... 5/453, 455, 456, 469, 5/654, 653, 914; 297/458, DIG. 3, DIG. 8, 284 R; 137/625.11, 625.13, 625.18; 91/35, 39, 40, 279

[56] References Cited

U.S. PATENT DOCUMENTS

| | | | |
|---|---|---|---|
| 961,231 | 6/1910 | Hinsdale | 5/456 |
| 2,278,246 | 3/1942 | Cordova | 137/625.11 |
| 3,822,425 | 7/1974 | Scales | 5/456 |
| 4,197,837 | 4/1980 | Tringali | 5/453 |
| 4,279,044 | 7/1981 | Douglas | 5/455 |
| 4,553,566 | 11/1985 | Barclay | 137/625.11 |
| 4,622,706 | 11/1986 | Takeuchi | 5/453 |
| 4,722,105 | 2/1988 | Douglas | 5/453 |
| 4,864,671 | 9/1989 | Evans | 5/453 |

FOREIGN PATENT DOCUMENTS

| | | | |
|---|---|---|---|
| 1459259 | 10/1965 | France | 5/456 |

*Primary Examiner*—Renee S. Luebke
*Assistant Examiner*—Flemming Soether
*Attorney, Agent, or Firm*—Cort Flint

[57] ABSTRACT

A pneumatic cushion for a wheel chair and the like is disclosed which comprises an air plenum box, a plurality of air openings in the air plenum box, and a plurality of air channels communicating with an air supply. The air channels communicate with the air openings to deflate and inflate individual air sacks carried over the air openings. The air sacks are unattached so that they act individually. An air distribution manifold includes a rotating blocking member to periodically block air distribution to the air sacks allowing them to deflate. The air sacks are constructed from a fabric having a low air permeability. The blocked air sacks thus allow air to escape through the sacks for deflation which cools the portion of the occupant seated on the cushion while allowing temporary pressure relief during deflation. The air sack inflation system is open so that, in addition, pressure may be relieved by a backward flow of air through the system. For this purpose, the blocking member which selectiely blocks air flow to the air sacks, is in the form of a one-way valve which blocks air in a first direction, but opens in a second direction to allow a bleed-off of air from the sacks should excessive pressures exist in the sacks such as caused by an occupant's weight shift and the like.

31 Claims, 3 Drawing Sheets

PNEUMATIC WHEEL CHAIR CUSHION FOR REDUCING ISCHEMIC INJURY

BACKGROUND OF THE INVENTION

The invention is directed to a pneumatic wheel chair cushion having a dynamic pressure relieving system for reducing ischemic injury to the weight bearing portions of the buttocks of a patient in a sitting position.

With the increasing number of wheel chair patients, the need for wheel chair cushions which provide for greater prevention of ischemic injury are needed. Typically, wheel chair cushions have been provided in various forms and shapes cut from foam. Other wheel chair cushions have been provided which include air cushions. U.S. Pat. No. 4,864,671 discloses a controllably inflated wheel chair cushion that includes a number of independently inflatable rows of cells. The cells are inflated and deflated according to a sequence selected by the user to selectively relieve pressure against the buttocks of the patient. The cells are inflated at a predetermined pressure and may not be deflated until a valve is opened to exhaust the cell. The cells are exhausted through a manifold which delivers air between the cells in order to supply fresh air and reduce the heat from the cushion. However, the system may not satisfactorily compensate a patient's weight causing excessive pressure on inflated portions. U.S. Pat. No. 4,852,195 discloses a similar fluid pressurized cushion which utilizes air cells arranged in a matrix. The air cells are inflated and deflated in a sequence to shift body support from one set of cells to another for promoting blood circulation and comfort. The cells in each matrix may also be interconnected to shift fluid pressure as the patient's weight may shift. While the above air cushions deflate to periodically alleviate pressure against the occupant's buttocks, the air cells are generally static and closed by valves and may not suitably allow pressure to be automatically relieved in instances where the patient's body weight shifts. The pressurized cushions are alternating, but are static. While the air cells or cushions are filled and pressurized with air, that pressure cannot change until the air pressure is released. This may not be satisfactory for severe cases of amputated wheel chair patients whose lower stump is very susceptible to acute ischemic injury and skin decay.

Accordingly, an object of the present invention is to provide an pneumatic wheel chair cushion having a dynamic air distribution system which periodically relieves pressure on portions of the occupant's buttocks.

Another object of the invention is to provide a pneumatic cushion having a dynamic air distribution system which is self regulating and adjusts to the shift in weight of the occupant to automatically relieve pressure and prevent ischemic injury.

Another object of the present invention is to provide a pneumatic cushion for a wheel chair and the like which utilizes individual air sacks which are inflated and deflated in a sequence to periodically reduce pressure against portions of the occupant's buttocks wherein the air sacks are controlled by a dynamic air pressurization system which allow a backflow of air to bleed from the air sacks under excessive pressure to prevent ischemic injury.

Another object of the present invention is to provide a pneumatic cushion for a wheel chair and the like which uses individual air sacks arranged in a matrix which can be alternately inflated and deflated wherein the fabric of the air sacks has a low air permeability which allows a certain amount of the air to escape to maintain the cushion dry and also to assist in automatically regulating the air pressure to shift in occupant's weight.

SUMMARY OF THE INVENTION

The purpose of this invention is to prevent ischemic injury to the weight bearing portions of the buttocks while in a sitting position. This object is accomplished by providing an air cushion having a number of separate unattached air sacks or cells arranged in a matrix. Reduced air flow and therefore reduced pressure is provided within the cushion periodically so each air sack on the surface will have reduced pressure and reduced flow for 12 seconds every minute, for example, dependent on a clock motor. An air distribution is provided which at any time, is self-regulating because if pressures increase when the occupant shifts their weight or the like, the system automatically buffers the area of exerted weight by a back flow of air to a blower when the pressure of the occupant exceeds the pressure in that cushion. The cushion is self-adjusting, and prevents acute trauma to an area. The air distribution system and cushion allow spontaneous, automatic adjustment in pressure just from the patient shifting his weight so that it minimizes the potential for soft tissue injury at any point in time. There is no closed valve in the system. The system is a dynamic pressure and flow pressure system. The air system is continually being charged so that if it is overcome by weight shifts, the air pressure is bled back.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
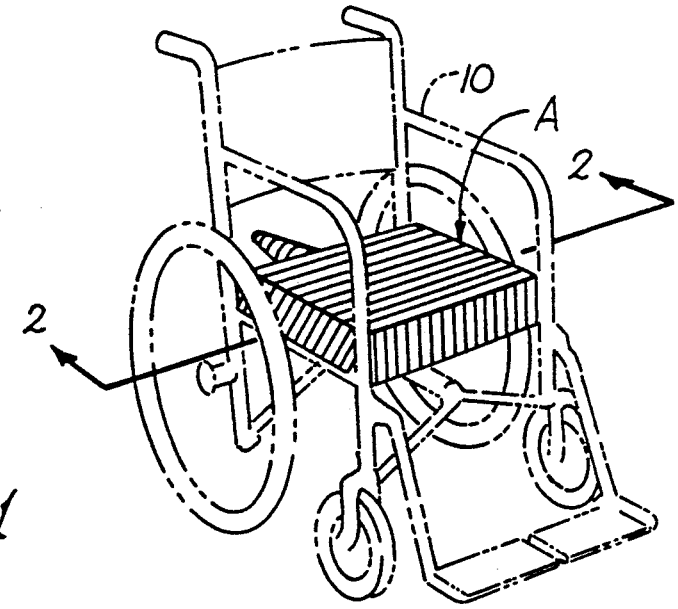
FIG. 1 is a perspective view illustrating a pneumatic cushion constructed according to the invention embodied in a wheel chair.

Referring now in more detail to the drawings, a pneumatic cushion A for reducing ischemic injury to a patient sitting in the wheel chair and the like is illustrated. As applied to a wheel chair, a support is provided by a wheel chair frame 10, and pneumatic cushion A is carried by the frame. Cushion A includes a dynamic, self-regulating air distribution system which periodically reduces air pressure in selected portions of the cushion. The air distribution system includes an air distribution plenum B having a plurality of air channels C. Plenum B includes a plenum box 12 having a plurality of air compartments D formed in the box communicating with air channels C. The air compartments are arranged in an N×N matrix where N is the number of compartments D in a row. In the illustrated embodiment, there are five rows 14a–14e, each having five air sacks S.

The system includes an air distribution manifold M which extends centrally through air plenum box 12 with air channels C extending laterally from central air distribution manifold F. There are four major air channels 16, 18, 20, 22 extending from the manifold, as can best be seen in FIG. 2. Air distribution manifold F includes a cylindrical air distribution tube 24 having an air inlet 26 formed at a first end of the air distribution manifold which includes an annular disk 28 with a plurality of circumferentially spaced holes 30 for the entry of air. A center bearing 32 rotatably receives one end of a rotating program member which has a shaft 34. There is a fitting 36 carried by the air inlet for connection to a blower 38 for delivering air to the air inlet. An opposite end of shaft 34 is coupled to a clock motor 39 using a set screw 37 by which shaft 34 is rotated in a programmed manner.

Figure 2:
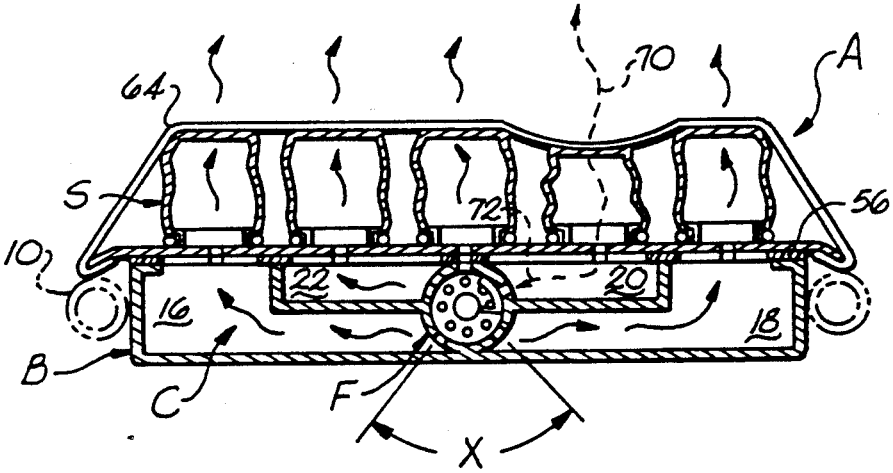
FIG. 2 is a sectional view taken along line 2—2 of FIG. 1.
Figure 3:
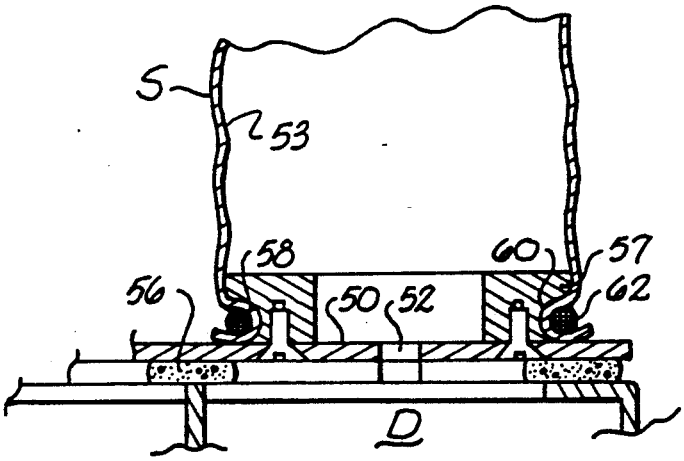
FIG. 3 is an enlarged sectional view of an individual air cell for a pneumatic cushion according to the invention.
Figure 4:
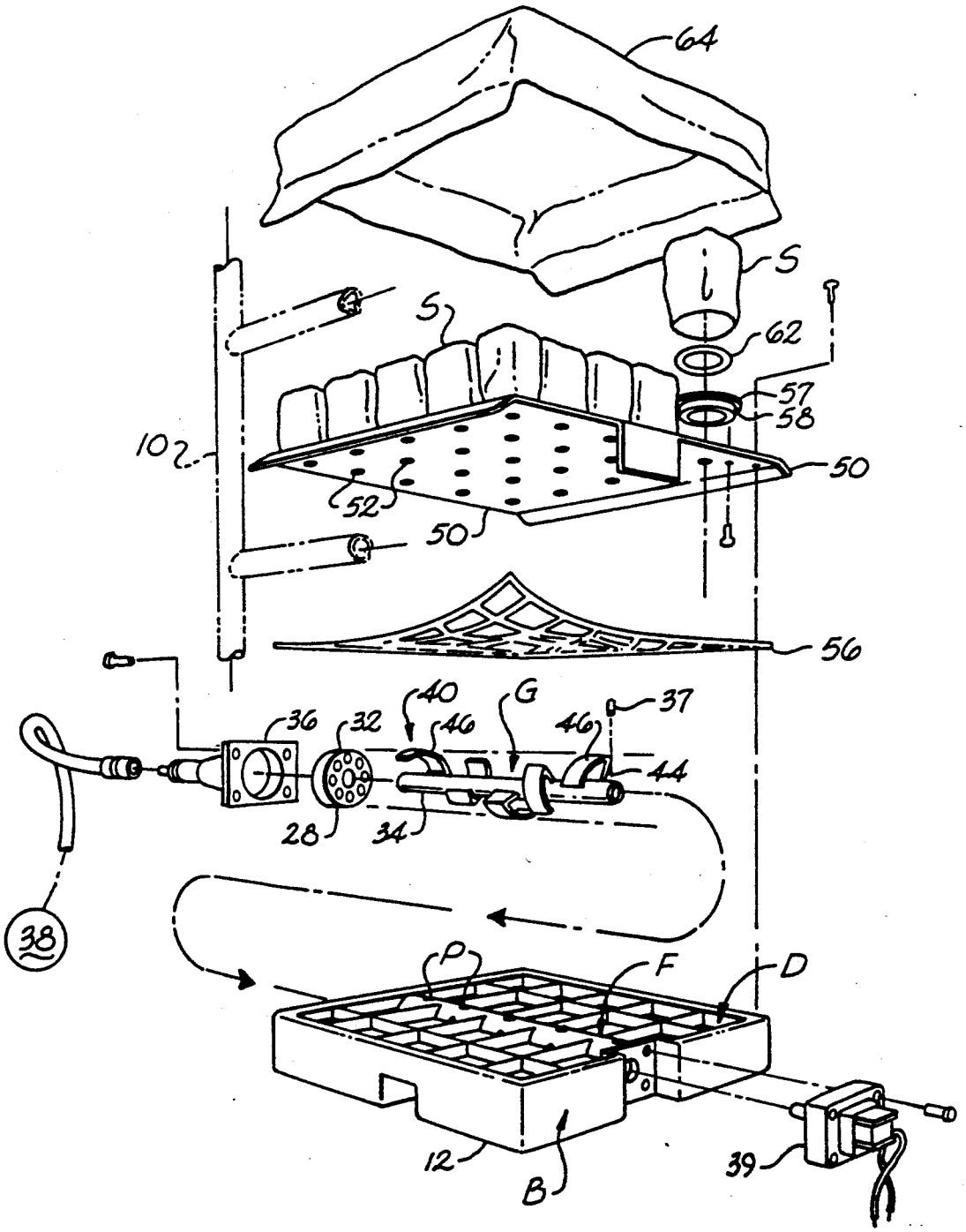
FIG. 4 is a perspective view with parts separated of a pneumatic cushion according to the invention.
Figure 6:
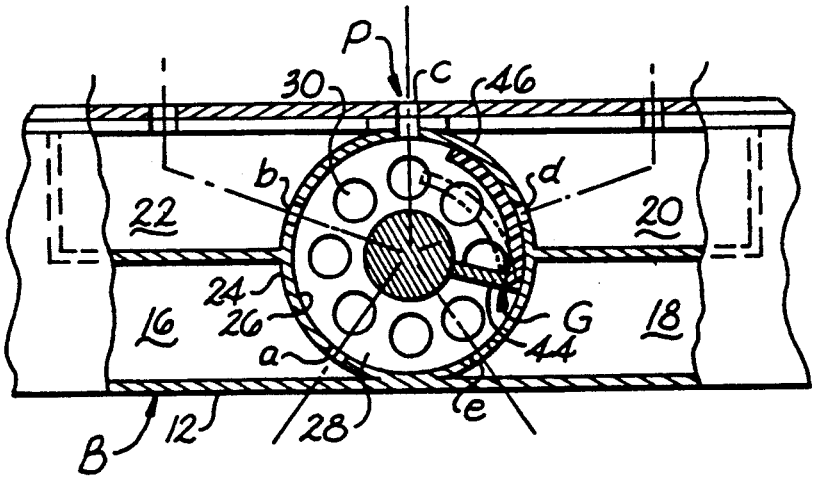
FIG. 6 is a sectional view taken through an air distribution manifold according to the invention.

As can best be seen in FIG. 6 and 4, there are a plurality of air distribution ports P in air distribution manifold F which are in fluid communication with air channels C in air distribution plenum B. The air distribution ports include air ports a, b, c, d, e spaced equiangularly around cylindrical air distribution manifold F. Where N is the number of rows, the angular spacing "X" of ports P is 360/N degrees around the circumference of cylindrical manifold F. In the illustrated embodiment, the five air ports for each row of air sacks have a 72 degree spacing circumferentially and are spaced a predetermined length longitudinally along manifold F (FIG. 2).

Figure 5:
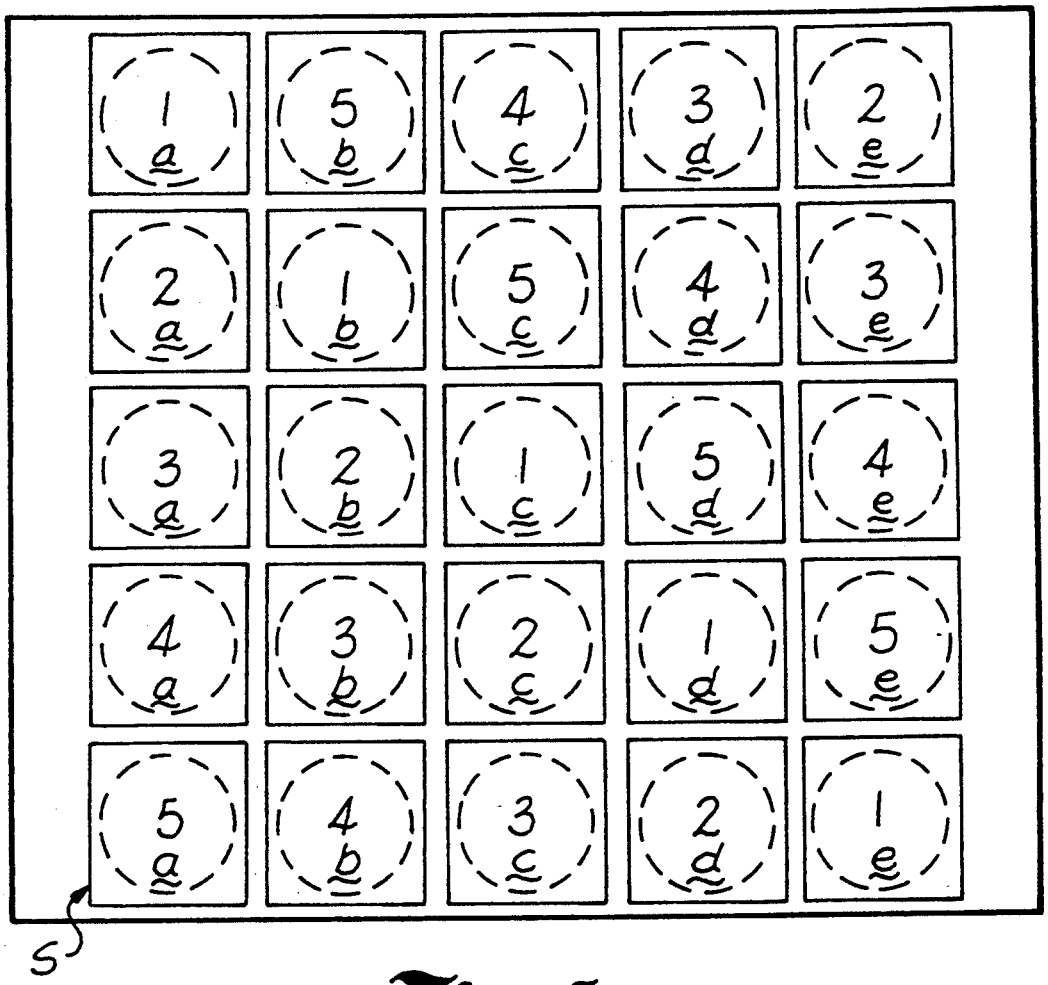
FIG. 5 is a top plan view of individual air sacks according to the invention illustrating a prescribed inflation/deflation sequence for relieving ischemic injury to the occupant.

Air blocking means G is provided for periodically blocking air distribution ports P in the manifold to periodically interrupt the distribution of air in air channels C and deflate air sacks S in accordance with a preselected sequence. The air blocking means includes rotating program member 34 having rotating one-way valve means 40 with a blocking position in which the valve means is positioned over an air port P. In this position, valve means blocks air to deflate air sacks S while, at the same time allowing air to backflow in the system and vent from the air sack as where excessive pressure occurs from a person's shifting weight. The valve means includes flexible wipers carried at programmed positions on shaft 34 which block air distribution ports P. The wipers are angularly spaced from one another on said shaft with same spacing as between air ports, and same longitudinal spacing. Flexible wipers include a stem 44, and a flapper valve 46 which engages the inside diameter of cylindrical air distribution manifold F (FIG. 6). As can best be seen in FIG. 5, air sacks are deflated in diagonal rows from one corner to an opposite corner. Drive motor 39 carried by a second end of said air distribution manifold rotatably drives said rotating program member 34.

A top member 50 extends over the top of said air distribution plenum B having a plurality of air openings 52 in fluid communication with air channels C. There is an air opening over each air compartment D so that there are N×N air openings 52. Sealing means 56 in the form of a matrix gasket seals between air compartments D and top member 50, as can best be seen in FIGS. 4 and 2. Inflatable air sacks S are carried by top member 50 over air openings 52, and are deflated as air distribution ports P are periodically blocked in accordance with the preselected sequence shown in FIG. 5. In the illustrated embodiment, there are 5 sets of circumferentially spaced ports spaced along the length of manifold F, as can best be seen in FIG. 4. The air cells and sacks controlled by ports a–e are designated in FIG. 5. The air sacks are sequentially inflated and deflated for reducing ischemic injury to a person seated on the cushion. Air sacks S are constructed from a material 53 having a low air permeability to allow slight air escapement from the air sacks to relieve excessive pressure above and prevent accumulation of moisture between the cushion and occupant. For this purpose, it will be seen that the individual air sacks are unattached to act individually during inflation and deflation for proper support and relief to prevent ischemic injury. The fabric of the air sacks and cover is characterized in that the fabric is microporous, having a low transmission of air and water vapor, but which blocks liquid transmission. Suitable fabrics are constructed from a fine weave pattern, and either coated, laminated, or impregnated with a material such as expanded Teflon. Suitable fabrics are sold under the commercial names of Goretex which is manufactured by the W. L. Gore Company, Ultrex manufactured by Burlington Industries of Greensboro, N.C., and Storm Shed manufactured by Reeves Brothers Manufacturing Company of Gaffney, S.C.

A plurality of annular flanges 57 surround air openings 52 in top member 50 having an undercut 58 for receiving a lower edge 60 of the air sacks. An elastic retaining means 62 secures the lower edge of the air sacks underneath the undercut. A cover 64 extends over the plurality of air sacks S which is secured around the periphery of top member 50. Both air sacks S and cover 64 are preferably constructed from a low air permeable fabric which allows air to escape from the air sacks to dry moisture in the buttocks area of the person seated on the cushion through flow through the cover. It will be noted that the fabric maintains air for sufficient pressure to support the person during the inflation/deflation sequences, but bleeds air to prevent excessive pressure and moisture. The air pressure in the air sacks automatically adjusts to the shifting of weight of a patient on the cushion. An open air distribution path extends from the blower to the air sacks which are not blocked which allows the backwards flow of air from said air sacks to the blower in the event of over pressurization of the air sacks due to the weight of the patient. At the same time, the blocked air ports may be relieved through the open path by the flapper valves as shown in the direction of arrow 70, and the air sack fabric, having low air permeability, retains air during normal sitting pressures, but allows escapement of air outwardly in the event of excess pressure as shown by arrow 72.

While a preferred embodiment of the invention has been described using specific terms, such description is for illustrative purposes only, and it is to be understood that changes and variations may be made without departing from the spirit or scope of the following claims.

What is claimed is:

1. Apparatus for reducing ischemic injury to a patient which includes a wheel chair frame and a pneumatic cushion carried by the frame wherein said pneumatic air cushion comprises:

an open dynamic air distribution system which periodically reduces air pressure in selected portions of the cushion wherein said air distribution system includes:

an air distribution plenum having a plurality of air channels;

an air distribution manifold carried within said plenum for distributing air to said air channels having an air inlet;

said air distribution manifold extending generally centrally through said air plenum box with said air channels extending laterally from said central air distribution manifold;

a plurality of air ports in said air distribution manifold in open fluid communication with said air channels within said air distribution plenum;

air blocking means for periodically blocking said air ports in said manifold to periodically interrupt the distribution of air in said air channels in accordance with a preselected sequence;

a top member extending over the top of said air distribution plenum having a plurality of air openings in fluid communication with said air channels;

a plurality of inflatable air sacks carried by said top member over said air openings which are inflated and deflated according to a preselected pattern for reducing ischemic injury to a person seated on said wheel chair;

a cover extending over said plurality of air sacks which is secured around the periphery of said air sack; and a blower for delivering air to said air inlet of said air distribution manifold.

2. The apparatus of claim 1 wherein said air distribution plenum includes a plenum box over which said top members extend.

3. The apparatus of claim 2 wherein said air distribution manifold includes a cylindrical air distribution tube extending centrally through said air plenum.

4. The apparatus of claim 2 wherein said plenum includes a plurality of enclosed air compartments formed in said communicating with said air channels.

5. The apparatus of claim 4 wherein said air compartments are arranged in an N×N matrix where N is the number of compartments in a row.

6. The apparatus of claim 4 including an air opening over each said air compartment.

7. The apparatus of claim 6 including sealing means sealing between said air compartments and said top member.

8. The apparatus of claim 1 wherein said air distribution manifold includes a cylindrical air distribution tube extending centrally through said air plenum.

9. The apparatus of claim 8 wherein said air inlet is formed at a first end of said air distribution manifold tube.

10. The apparatus of claim 9 including a fitting carried by said air inlet for connection to a blower which delivers air to said air inlets and air distribution manifold.

11. The apparatus of claim 9 wherein said air inlet includes an annular disk carried by said manifold tube having a plurality of circumferentially space holes for the entry of air, and said air blocking means includes a rotating sequencing member having an end rotatably received in a center bearing carried by said annular disk.

12. The apparatus of claim 1 wherein said air cells are arranged in N rows where N is the number of rows, and said air distribution manifold includes a cylindrical manifold, and said air distribution ports are spaced equiangularly around said cylindrical manifold.

13. The apparatus of claim 12 wherein said air distribution ports corresponding to a prescribed row are spaced 72 degrees circumferentially, and the air distribution ports of sequential rows are spaced a predetermined length along said air distribution manifold.

14. The apparatus of claim 12 wherein said spacing is 360/N degrees.

15. The apparatus of claim 14 wherein said air blocking means includes a rotating program member for blocking said air distribution ports according to said prescribed sequence.

16. The apparatus of claim 15 wherein said rotating program member includes a rotating shaft and a plurality of wipers carried at programmed positions on shaft which block air distribution ports.

17. The apparatus of claim 14 wherein said wipers are angularly spaced from one another and staggered circumferentially on said shaft corresponding to said equiangular spacing between said air ports, and said wipers include flexible valve elements which engage an inside diameter of cylindrical air distribution manifold to block said air ports and flex away from said air ports to automatically relieve pressure in a blocked air cell.

18. The apparatus of claim 1 wherein said air sacks are unattached and are constructed from a material having a low air permeability which allows slight air escapement from said air sack to relieve pressure in a generally self-regulating manner and prevent accumulation of moisture.

19. The apparatus of claim 18 wherein said air sack material is constructed from a low air permeable fabric through which transmits a low flow of air to prevent moisture in the buttocks area of person seated on the wheel chair.

20. The apparatus of claim 1 including a plurality of annular flanges surrounding said air openings in said top member having an undercut for receiving a lower edge of said air sacks.

21. The apparatus of claim 20 including elastic retaining means for securing said lower edge of said air sacks underneath said undercut.

22. The apparatus of claim 1 wherein said air blocking means automatically includes pressure relief means for automatically unblocking said air ports in the event a certain pressure is exceeded in said air sack.

23. The apparatus of claim 22 wherein said pressure relief means includes a valve means which blocks air through said air ports in a first direction and vents air through said air ports in a second opposite direction.

24. The apparatus of claim 1 wherein said air sacks are arranged in an N×N matrix where N is the number of air sacks in a row, and said matrix or air sacks deflate diagonally from one corner of said N×N matrix to another.

25. A pneumatic cushion for reducing ischemic injury to a person accommodated on the cushion comprising:

a pneumatic cushion having a plurality of individual inflatable air sacks;

air supply means for supplying air to inflate said air sacks;

air delivery means for delivering an inward air flow from said air supply means to air sacks at a system pressure which includes an air path from said supply means to said air sacks;

self-regulating air flow control means having an open position for transmitting said inward air flow from said air delivery means to said air sacks in a first direction for inflating said sacks in a prescribed sequence, while simultaneously allowing a backward air flow in a second, opposite direction to prevent excessive pressure in said air sacks in a self-regulating manner when said air flow control means is in said open position; and said air flow control means having a blocked position for preventing said inward air flow, and said air flow control means being moved from said blocked position directly by excessive pressure in said air sack greater than said system pressure for allowing said backward air flow to prevent excessive pressures in said air sacks in a self-regulating manner.

26. The apparatus of claim 25 wherein said air sacks are arranged in rows and said rows are deflated diagonally from one corner of said rows to another.

27. The apparatus of claim 26 wherein said air sacks are arranged in an N×N matrix where N is the number of air sacks in a row, and said matrix of air sacks deflate diagonally from one corner of said N×N matrix to another.

28. The apparatus of claim 25 wherein said air sacks are constructed from a material having low air permeability which retains air during normal sitting pressures, but allows escapement of air outwardly in the event of excessive pressures caused by said patient weight shifts and the like.

29. The apparatus of claim 25 including a cover extending over said plurality of air sacks which is secured around the periphery of said air sack constructed from a low air permeable fabric which allows air to escape from air sacks to escape said cover and dry moisture in the buttocks area.

30. The apparatus of claim 25 wherein said air flow control means includes air blocking means which is opened directly by said excessive pressures to transmit said back air flow when said air flow control means is in a closed position.

31. Apparatus for reducing ischemic injury to a patient which includes a wheel chair frame and a pneumatic cushion carried by the frame wherein said pneumatic air cushion comprises:

an open dynamic air distribution system which periodically reduces air pressure in selected portions of the cushion wherein said air distribution system includes;

an air distribution plenum having a plurality of air channels;

an air distribution manifold carried within said plenum for distributing air to said air channels having an air inlet;

a plurality of air ports in said air distribution manifold in open fluid communication with said air channels within said air distribution plenum;

air blocking means for periodically blocking said air ports in said manifold to periodically interrupt the distribution of air in said air channels in accordance with a preselected sequence;

a top member extending over the top of said air distribution plenum having a plurality of air openings in fluid communication with said air channels;

a plurality of inflatable air sacks carried by said top member over said air openings which are inflated and deflated according to a preselected pattern for reducing ischemic injury to a person seated on said wheel chair;

a cover extending over said plurality of air sacks which is secured around the periphery of said air sack;

a blower for delivering air to said air inlet of said air distribution manifold;

said air sacks are arranged in N rows where N is the number of rows, and said distribution manifold includes a cylindrical manifold, and said air distribution ports are formed in said cylindrical manifold; and said air distribution ports corresponding to a prescribed row are spaced circumferentially around said manifold, and the air distribution ports of sequential rows are spaced a predetermined length along said manifold.

* * * * *